US007491296B2

(12) United States Patent
Fredriksson

(10) Patent No.: US 7,491,296 B2
(45) Date of Patent: Feb. 17, 2009

(54) MULTI-STAGE SCREENING APPARATUS, SCREEN BASKET AND METHOD FOR SCREENING PULP SUSPENSIONS

(75) Inventor: Börje Fredriksson, Grästorp (SE)

(73) Assignee: Metso Paper, Inc. (FI)

( * ) Notice: Subject to any disclaimer, the term of this patent is extended or adjusted under 35 U.S.C. 154(b) by 382 days.

(21) Appl. No.: 10/512,676

(22) PCT Filed: May 8, 2003

(86) PCT No.: PCT/SE03/00746

§ 371 (c)(1),
(2), (4) Date: Jul. 7, 2005

(87) PCT Pub. No.: WO03/104549

PCT Pub. Date: Dec. 18, 2003

(65) Prior Publication Data

US 2006/0070924 A1 Apr. 6, 2006

(30) Foreign Application Priority Data

Jun. 7, 2002 (SE) ..... 0201746

(51) Int. Cl.
*D21C 7/06* (2006.01)

(52) U.S. Cl. ..... 162/246; 162/251; 162/55; 209/305

(58) Field of Classification Search ..... 162/246, 162/251, 55; 209/305, 273, 406
See application file for complete search history.

(56) References Cited

U.S. PATENT DOCUMENTS

| | | | |
|---|---|---|---|
| 4,157,302 | A | 6/1979 | Bergstedt |
| 5,968,315 | A | 10/1999 | Meinander |
| 6,080,274 | A | 6/2000 | Hautala et al. |
| 6,679,384 | B1 | 1/2004 | Serres et al. |

FOREIGN PATENT DOCUMENTS

| | | | |
|---|---|---|---|
| EP | 0 473 354 | B1 | 3/1992 |
| EP | 1 155 185 | B1 | 4/2004 |
| FR | 2 613 390 | A1 | 10/1988 |
| SE | 506 602 | C2 | 1/1998 |
| WO | WO-93/23609 | A1 | 11/1993 |
| WO | WO-93/28549 | A1 | 6/1999 |

*Primary Examiner*—Mark Halpern
(74) *Attorney, Agent, or Firm*—Lerner, David, Littenberg, Krumholz & Mentlik, LLP

(57) ABSTRACT

Screening apparatus for screening pulp suspensions is disclosed comprising a screen basket dividing the interior of the housing into a central chamber and a single outer annular chamber. The suspension is supplied to one of the outer and central chambers, so that an accept fraction passes through the screen, while a reject fraction develops that is prevented from passing through the screen. Dilution is provided by supplying diluting liquid to dilute the reject fraction. The screen basket is divided into at least two separate tubular screen sections. The dilution is provided by at least one annular element axially interconnecting the two tubular screen sections and forming a tubular dilution liquid compartment extending at least substantially around the screen basket. The annular element forms a plurality of dilution liquid ejection passages between the dilution liquid compartment and one of the outer and central chambers.

12 Claims, 4 Drawing Sheets

MULTI-STAGE SCREENING APPARATUS, SCREEN BASKET AND METHOD FOR SCREENING PULP SUSPENSIONS

This application is a 371 of PCT/SE03/00746 filed on Aug. 5, 2003.

FIELD OF THE INVENTION

The present invention relates to a screening apparatus for screening pulp suspensions, comprising a housing, a tubular screen basket dividing the interior of the housing into a central chamber and an outer substantially annular chamber, an inlet member for supplying a suspension to be screened into one of the central chamber and outer chamber, and an accept outlet member for discharging a developed accept fraction of the suspension that has passed through the screen basket. The apparatus further comprises, a reject outlet member for discharging a developed reject fraction of the suspension, a rotor arranged in the housing for providing pressure and suction pulses in the suspension to be screened along the screen basket, and dilution means for supplying diluting liquid to one of the central chamber and outer chamber.

The present invention also relates to a screen basket for use in such an apparatus and methods of screening pulp suspensions in several screening stages.

BACKGROUND OF THE INVENTION

A very important step in the papermaking process is screening of fiber pulp suspensions. Traditionally, the pulp suspension is screened by several so-called pressure screening apparatus of the type described above interconnected in a system of screening apparatuses, in which each screening apparatus represents a screening stage dependent on the other stages of the system.

As an alternative to the traditional screening system with several interconnected screening apparatus, one single screening apparatus may be designed with several stages, typically two or three stages, incorporated into the same screen body. A variety of such multi-stage screening apparatus of various designs have recently been introduced to the market.

The increasing size of the paper making production lines of today has resulted in very large screening apparatus. Especially screening apparatus for low consistency pulp suspensions is large and has a very large screen basket, in order to accommodate high hydraulic loads. The screen baskets for different screening apparatus are typically designed with about the same aspect ratio—length/diameter—regardless of size, so that a large basket is very long. Another reason why many screen baskets are long is the fact that it is considerably cheaper to increase the size of a given screen by increasing the length of the screen basket as compared to increasing the diameter thereof.

In a long screen basket the path of travel for debris particles will be long. As a consequence, a long screen basket has the disadvantage that since the retention time for the individual particle that is to be rejected will be long the probability of acceptance or breakdown will be higher than in shorter screen baskets. Furthermore, a long screen basket is likely to encounter problems with reject fraction thickening and will have lower capacity per unit surface area as well as reduced removal efficiency.

One way to counteract the reject fraction thickening is to dilute it with dilution liquid, typically water, and there are prior screening apparatus provided with arrangements to add dilution water to the inside of the screen basket for this purpose. For example, U.S. Pat. Nos. 6,080,274 and 6,186,333, and WO 00/50690 disclose expensive dilution water arrangements built into multi-stage screening apparatus. A serious disadvantage of these known multistage screening apparatus is the need for expensive hardware for process control in form of very large valves and flow meters on the accept lines from the different stages. Each accept compartment requires a separate flow control with flow meters and control valves.

Another known dilution arrangement includes revolving dilution water outlets integrated into the rotor. However, with this kind of dilution arrangement it is difficult to get the pressurized dilution water from the screen housing into the rotor. There are seals between stationary and rotary parts of the apparatus that often have wear problems, so that fibers pass through the seals into the dilution water compartments and eventually plug the outlets for dilution water. Another known dilution arrangement includes stationary dilution water outlets below the screening zone, and integrated into the screen housing. With these fairly expensive known arrangements it is very difficult to transport the dilution water to the optimum destination in the screen basket.

Swedish patent application No. 9601979-9 proposes a solution to the above noted problems and discloses a dilution arrangement in which dilution water is introduced into a channel circumventing a wedge wire type of screen basket. The channel is formed by putting a lid over the space between two support rings on the screen basket. The dilution water is fed into the screen basket through screening slots provided on the mantle wall of the screen basket. However, a problem with this solution is that the flow of dilution water entering the inside of the screen basket through the many very fine screen slots is insufficient and cannot provide for enough penetration and mixing of the dilution water and the thickened reject fraction. Another problem is leakage of unknown quantities of water to the accept chamber located external to the screen basket through the axially open spaces at the outer narrow ends between the wedge shaped bars and the fixation and support rings, that constitute the top and bottom of the dilution water channel.

One object of the present invention is to provide a screening apparatus for screening pulp suspension in stages having a simple, inexpensive dilution means that supplies dilution liquid to an optimum destination in the screen basket for efficient dilution of the reject fraction.

Another object of the invention is to provide a screen basket for use in the screening apparatus of the present invention and also for replacing worn out screen baskets in existing screening apparatuses.

Yet another object of the present invention is to provide a method of screening pulp suspension in stages so that the developed reject fraction is diluted in an optimum manner.

The initial object set forth above is obtained by a screening apparatus of the type described initially characterized in that the screen basket includes at least two separate tubular screen sections, and that the dilution means comprises at least one annular element axially interconnecting the two tubular screen sections and forming a tubular dilution liquid compartment extending at least substantially around the screen basket, the annular element forming a plurality of dilution liquid ejection passages between the dilution liquid compartment and one of the central chamber and outer chamber.

As a result, the required amount and velocity of the dilution liquid jets sprayed from the ejection passages to provide efficient dilution of the reject fraction is easy to achieve by properly designing the size of the ejection passages.

SUMMARY OF THE INVENTION

In accordance with an embodiment of the present invention, one of the accept outlet member and reject outlet member, normally the accept outlet member, forms an outlet passage from the outer chamber, and the dilution means comprises at least one dilution liquid supply conduit extending through the outlet passage to the annular element, to supply dilution liquid from outside the housing to the dilution liquid compartment. This embodiment enables easy and inexpensive connection of the dilution liquid supply conduit with the annular element, because there is no need for any separate connection through the housing. The outlet member may include a releasable outlet portion situated outside the housing, wherein the dilution liquid supply conduit extends through the wall of the releasable outlet portion.

In accordance with another embodiment of the present invention, the dilution means comprises first and second dilution liquid supply conduits connected to the annular element at different places thereon. This embodiment provides a more even distribution of dilution liquid into the screen basket.

In both of these embodiments the tubular dilution liquid compartment may extend in a closed loop around the screen basket, and the dilution liquid supply conduit may be arranged to direct the dilution liquid into the dilution liquid compartment such that the dilution liquid flows in one direction along said closed loop. As a result, the flow of dilution liquid circling in the dilution liquid compartment will counteract fibers that might enter the compartment from depositing on the compartment wall.

Another of the objects of the present invention is obtained by a screen basket, which comprises a tubular mantle wall provided with screen holes, and dilution means for supplying dilution liquid to one of the inside and outside of the tubular mantle wall. The screen basket is characterized in that the tubular mantle wall includes at least two separate tubular wall sections, and the dilution means comprises at least one annular element axially interconnecting the two tubular wall sections of the mantle wall and forming a tubular dilution liquid compartment extending at least substantially around the tubular mantle wall, the annular element forming a plurality of dilution liquid ejection passages between the dilution liquid compartment and one of the inside and outside of the screen basket.

An important advantage of the screen basket of the present invention is that it is well suited for replacing worn out screen baskets in existing single-stage screening apparatuses, thereby functionally converting the existing apparatuses into multi-stage apparatuses.

The ejection passages may have circular cross-sections or, alternatively, take the shape of slots.

Suitably, the tubular dilution liquid compartment has a rectangular cross-section and extends in a closed loop around the tubular mantle wall.

The dilution means may comprise first and second dilution liquid supply inlets on the annular element positioned at different places thereon.

Another of the objects of the present invention is obtained by a method of screening a pulp suspension by the use of a screening apparatus having a tubular screen basket. The method comprises:

feeding the suspension to be screened to one of the external side and internal side of the screen basket, screening the suspension along a primary screening section of the screen basket to obtain a primary accept fraction that passes through the screen basket and a primary reject fraction that is prevented from passing through the screen basket, supplying a flow of dilution liquid to dilute the primary reject fraction, screening the diluted primary reject fraction along a secondary screening section of the screen basket to obtain a secondary accept fraction that passes through the screen basket and a secondary reject fraction that is prevented from passing through the screen basket, discharging the secondary reject fraction from the screen basket, and combining the primary and secondary accept fractions to form a common final accept fraction.

The method is characterized by:

controlling the flow of dilution liquid being supplied in response to the consistency and flow of the suspension being fed to the screen basket and the consistency and flow of the secondary reject fraction being discharged from the screen basket, so that the consistency of the primary reject fraction entering the secondary screening section becomes substantially the same as the consistency of the suspension being fed to the screen basket.

The suspension to be screened is normally fed into the internal side of the screen basket and is screened so that the primary reject fraction develops inside the screen basket, whereby the flow of dilution liquid is supplied to the inside of the screen basket and the secondary reject fraction develops inside the screen basket.

The method may further comprise supplying the flow of dilution liquid in the form of jets having a velocity in the range of 2-10 m/s, preferably 4-8 m/s.

The control of the flow of dilution liquid being supplied to the screen basket is based on an algorithm calculated as follows.

Thickening is the result of that the probability for acceptance through the screen barrier always is higher for water than for fiber. It is defined as the consistency increase from the feed end to the reject end of the screen basket. Thickening varies with the type of pulp, the production rate and with most design and operating variables of a pressure screen.

The thickening is the ratio F between reject consistency Cr and feed consistency Cf or the ratio between mass reject rate Rm and volumetric reject rate Rv.

$$F = \frac{Cr}{Cf} = \frac{Rm}{Rv} \tag{1}$$

with the assumptions that the thickening in the two screening stages in a two-stage system are the same and that the mass rejects rate are the same in the two stages it is possible to calculate the required amount of dilution water Qd. A prerequisite for this calculation is that the volume flow and mass consistency of the feed and the reject flows are known. From these assumptions it is possible to derive the following equation for the required amount of dilution water:

$$Qd = \sqrt{Qf * Qr}\left(\sqrt{\frac{Cr}{Cf}} - \sqrt{\frac{Cf}{Cr}}\right) \tag{2}$$

where Qd is the amount of dilution liquid, Qf is the volume flow of the feed, Qr is the volume flow of the reject fraction, Cf is the consistency (mass concentration) of the feed and Cr is the consistency of the reject fraction.

This is the algorithm that makes it possible to adjust and control the amount of dilution water so that the feed consistency, to the secondary screening stage of screen basket, will become the same as that of the primary stage. The input data required for this calculation is only feed—and final reject flow and the consistencies of these flows.

The control algorithm can also be written $$Qd=\sqrt{Qf*Qr}(\sqrt{F}-\sqrt{F^{-1}}) \quad (3)$$

As an alternative to the above method of the present invention, which relates to two-stage screening, one of the objects of the present invention also is obtained by a method for three-stage screening. Accordingly, the alternative method comprises:

- feeding the suspension to be screened to one of the external side and internal side of the screen basket,
- screening the suspension along a primary screening section of the screen basket to obtain a primary accept fraction that passes through the screen basket and a primary reject fraction that is prevented from passing through the screen basket,
- supplying a first flow of dilution liquid to dilute the primary reject fraction,
- screening the diluted primary reject fraction along a secondary screening section of the screen basket to obtain a secondary accept fraction that passes through the screen basket and a secondary reject fraction that is prevented from passing through the screen basket,
- supplying a second flow of dilution liquid to dilute the secondary reject fraction,
- screening the diluted secondary reject fraction along a tertiary screening section of the screen basket to obtain a tertiary accept fraction that passes through the screen basket and a tertiary reject fraction that is prevented from passing through the screen basket,
- discharging the tertiary reject fraction from the screen basket,
- combining the primary, secondary and tertiary accept fractions to form a common final accept fraction, The alternative method is characterized by:

- controlling the first and second, respectively, flow of dilution liquid being supplied to the screen basket in response to the consistency and flow of the suspension being fed to the screen basket and the consistency and flow of the tertiary reject fraction being discharged from the screen basket, so that the consistency of the primary reject fraction entering the secondary screening section and the consistency of the secondary reject fraction entering the tertiary screening section, respectively, becomes substantially the same as the consistency of the suspension being fed to the screen basket.

As mentioned above the suspension to be screened is normally fed into the internal side of the screen basket. Thus, the suspension is screened so that the primary reject fraction develops inside the screen basket, whereby the first and second flows of dilution liquid are supplied to the inside of the screen basket and the secondary and tertiary reject fractions develop inside the screen basket It is possible to derive a similar equation for the amount of dilution water required in the first $Qd_1$ and the second $Qd_2$ dilution water stage. The derivation of the formulas is similar to the case with two stages shown above.

The amount of dilution water required after the first stage of screening to obtain the same feed consistency to the second stage of screening as the feed to the screen, the first stage of screening can be calculated by the following formula:

$$Qd_1=\sqrt[3]{Qf^2*Qr}(\sqrt[3]{F}-\sqrt[3]{F^{-2}}) \quad (4)$$

The general formula for two and three stage applications is $$Qd_1=\sqrt[n]{Qf^{n-1}*Qr}(\sqrt[n]{F}-\sqrt[n]{F^{1-n}}) \quad (5)$$

where the number of screening stages is (n)

Under the same assumptions the required amount to the second dilution stage in three-stage screen basket is $$Qd_2=Qd_1\sqrt[3]{Rm} \quad (6)$$

where (Rm) is the total mass reject rate over the whole screen, after the three stages. Retrofits for all types of screens with long baskets, e.g. all screen baskets longer (higher) than 600 mm will benefit from the present invention. They will have increased capacity and/or efficiency by dividing a too long screening zone into a primary and a secondary stage. These positive effects are results of a more efficient utilization of the screen basket surface.

Another possibility to take advantage of this new concept is to operate with a more gentle surface profile of the screen basket that defines the screen holes for better removal efficiency. A too aggressive surface profile is not required to meet capacity demands. Multi-stage dilution will also make it possible to reduce the RPM of the rotor. At lower RPM the screening apparatus will pull lower electric load.

New product lines of screens can take advantage of this technology. No dilution arrangements will be required in the screen housing and/or in the screen rotor. A simpler and less expensive screen design can be used.

The multi-stage screening apparatus of the invention can be designed with only one accept compartment and with less expensive process control. For example, a two-stage screen with controlled mass reject rate based on state of the art technology requires four flow controls and two consistency controllers, whereas the multi-stage dilution technology according to the present invention requires only three and two controls respectively for the same information.

The same comparison for a three-stage apparatus is even more advantageous in favor of the present invention. The additional stage requires only one more flow controller. With conventional technology two more controllers would be needed.

If the multi-stage dilution technology is combined with control of the screen rotor RPM it will be possible to obtain maximum removal efficiency of a "two stage system" under very varying process conditions.

BRIEF DESCRIPTION OF THE DRAWINGS

The present invention is described in more detail in the following detailed description with reference to the accompanying drawings, in which.

DETAILED DESCRIPTION

Figure 1:
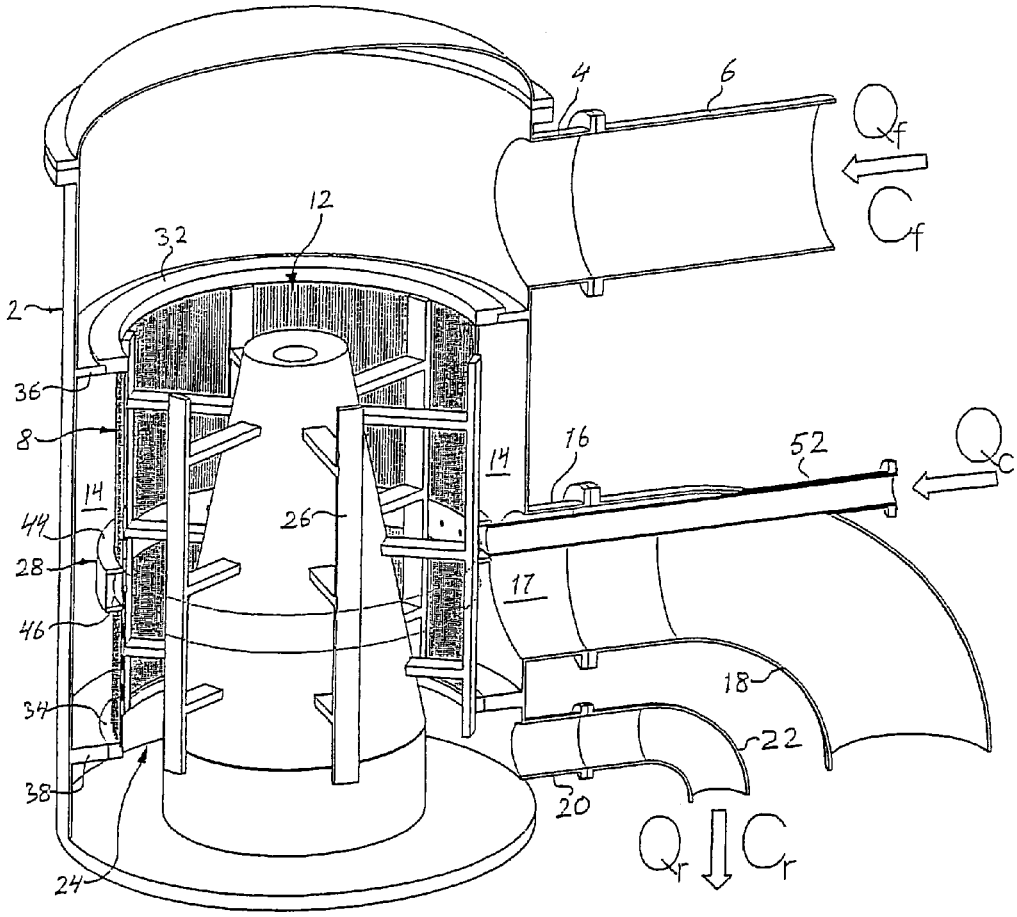
FIG. 1 is a side, perspective, partial cut-away view of a first embodiment of the screening apparatus of the present invention.

Identical components shown in the figures are denoted with the same reference numerals.

FIG. 1 shows a screening apparatus according to the present invention for screening pulp suspensions, comprising a housing 2, an inlet member 4 releasably connected to a supply pipe 6 for supplying a suspension to be screened into the housing 2, a tubular screen basket 8 dividing the interior of the housing 2 into a central substantially cylindrical chamber 10 for receiving the suspension to be screened at one end 12 of the central chamber and a single outer annular accept chamber 14 for receiving an accept fraction of the suspension that has passed through the screen basket 8, an accept outlet member 16 forming an outlet passage 17 and releasably connected to an accept outlet pipe 18 for discharging the accept fraction from the accept chamber 14 and a reject outlet member 20 releasably connected to a reject outlet pipe 22 for discharging a reject fraction of the suspension from the central chamber 10 at the other end 24 thereof. A rotor 26 is arranged in the central chamber 10 for providing pressure and suction pulses in the suspension along the internal side of the screen basket 8. Dilution means 28 is provided for supplying diluting liquid to the central chamber 10 between the ends 12 and 24 thereof.

Figure 3:
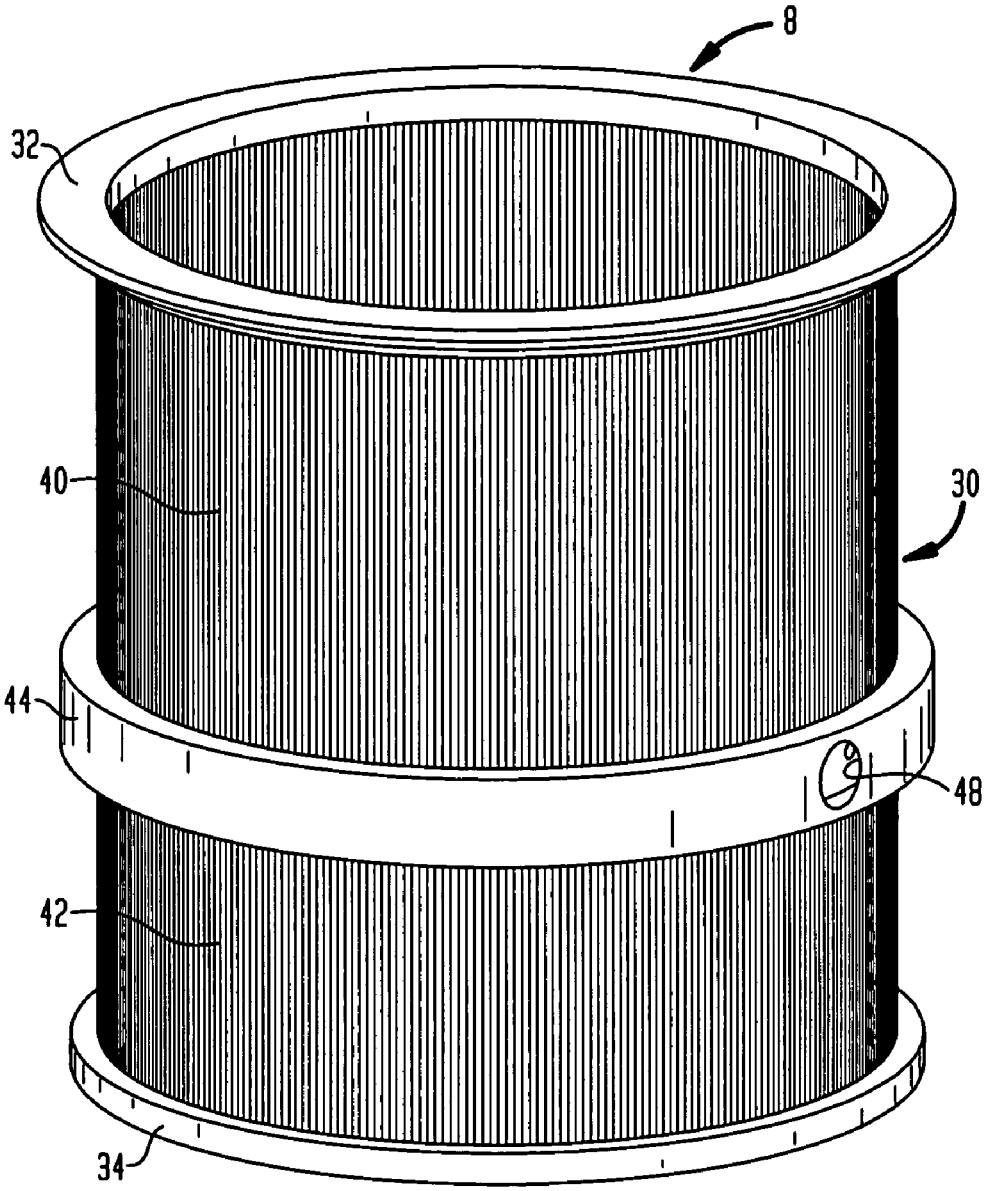
FIG. 3 is a side, perspective view of a screen basket that fits the apparatus according to FIG. 1.
Figure 4:
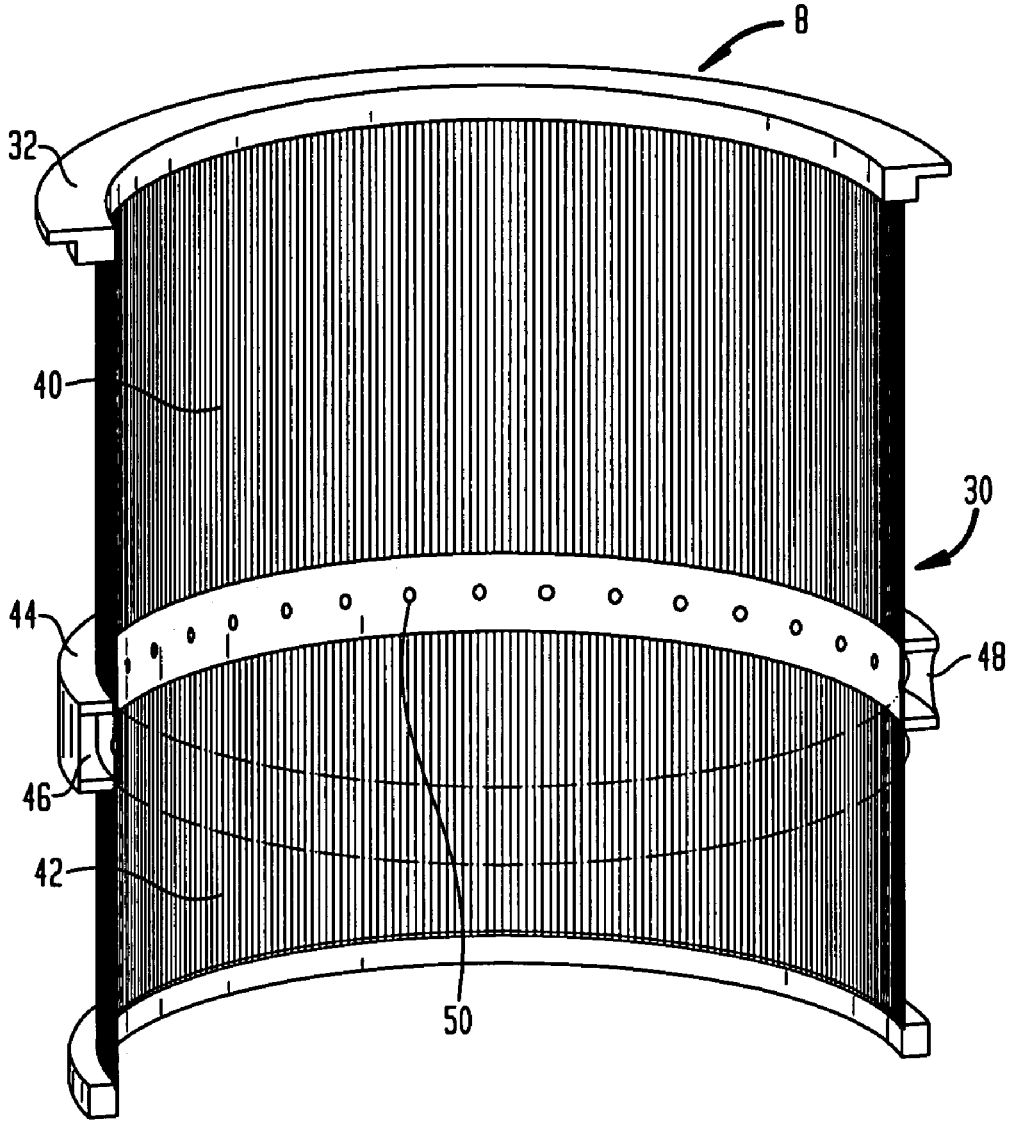
FIG. 4 is a side, sectional perspective view of the screen basket shown in FIG. 3.

The screen basket 8 comprises a cylindrical mantle wall 30 with screen holes taking the shape of slots. The mantle wall 30 is provided with an upper flange 32 and a lower flange 34 that seal against an upper shoulder 36 on the housing and a lower shoulder 38 on the housing, respectively. With reference to FIGS. 3 and 4, the mantle wall 30 is divided into two separate cylindrical sections 40 and 42, which are axially interconnected by an annular element 44 of the dilution means 28. The annular element 44 forms a tubular dilution liquid compartment 46 having a rectangular cross-section and extending around the mantle wall 30. The annular element 44 has a dilution liquid inlet opening 48 and a multiplicity of dilution liquid ejection passages 50 having circular cross-section and extending between the compartment 46 and the inside of the screen basket 8. A dilution liquid supply conduit 52 of the dilution means 28 for supplying dilution liquid from outside the housing 2 to the dilution liquid compartment 46 extends through the wall of the accept outlet pipe 18 and further through the outlet passage 17 of the accept outlet member 16 to the opening 48 of the annular element 44.

The screen basket 8 described above is particularly suited for replacing traditional single stage screen baskets in old screening apparatuses. By utilizing the existing accept outlet member to connect the dilution liquid supply conduit there is no need for reconstructing the housing of the old apparatus.

In operation, a fiber suspension to be screened is fed via the inlet member 4 to the screen basket 8 at the upper side 12 thereof. In the screen basket 8 the suspension is screened along section 40 of the mantle wall 30, so that a primary accept fraction passes through the mantle wall 30 while a primary reject fraction develops inside the screen basket 8. The primary reject fraction is diluted by a controlled flow of dilution liquid sprayed through the ejection passages 50. The diluted primary reject fraction is screened along section 42 of the mantle wall 30, so that a secondary accept fraction passes through the mantle wall 30 while a secondary reject fraction develops inside the screen basket 8 and then is discharged from the screen basket 8 through the reject outlet member 20. The primary and secondary accept fractions are combined and discharged through the accept outlet member 16.

The flow of dilution liquid through the ejection passages 50 is controlled in response to the consistency and flow of the suspension being fed to the screen basket 8 and the consistency and flow of the secondary reject fraction being discharged from the screen basket 8, so that the consistency of the primary reject fraction entering section 42 of the mantle wall 30 becomes substantially the same as the consistency of the suspension being fed into the screen basket 8.

The above-described embodiment of the present invention according to FIG. 1 is of a type most commonly used. However, in an alternative embodiment of the invention, not shown, the suspension is supplied to the outer chamber 14 and a rotor is arranged in the outer chamber 14 to provide pressure and suction pulses in the suspension along the external side of the screen basket 8. In this alternative embodiment, the liquid ejection passages extend between the compartment 46 and the outside of the screen basket 8, so that the primary reject fraction that develops outside the screen basket 8 can be diluted by liquid jets from the ejection passages.

Figure 2:
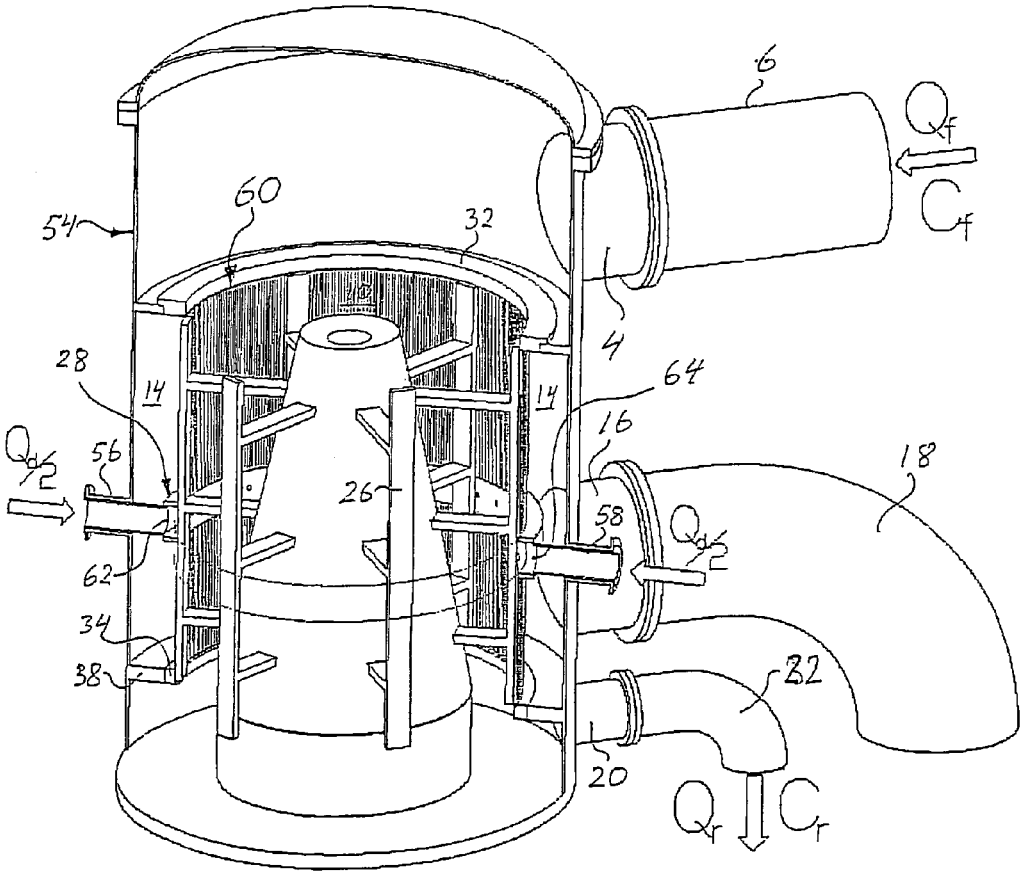
FIG. 2 is a side, perspective, partial cut-away view of a second embodiment of the invention.

FIG. 2 shows a screening apparatus of the present invention similar to the embodiment shown in FIG. 1 except that the screen basket and the dilution liquid supply are designed differently. Thus, the apparatus of FIG. 2 comprises a housing 54 provided with two dilution liquid inlet conduits 56 and 58, and a screen basket 60 provided with two dilution liquid inlet openings 62 and 64 connected to the conduits 56 and 58, respectively. This embodiment is suited for new screening apparatuses.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A screening apparatus for screening pulp suspensions, comprising:

a housing, a tubular screen basket dividing the interior of the housing into a central chamber and a single outer substantially annular chamber, the screen basket including at least two separate tubular screen sections, an inlet member for supplying a suspension to be screened into one of the central chamber and outer chamber, an accept outlet member for discharging a developed accept fraction of the suspension that has passed through the screen basket into said single outer substantially annular chamber, a reject outlet member for discharging a developed reject fraction of the suspension, a rotor arranged in the housing for providing pressure and suction pulses in the suspension to be screened along the screen basket, and dilution means for supplying diluting liquid to one of the central chamber or outer chamber, the dilution means including at least one annular element axially interconnecting the two tubular screen sections and forming a tubular dilution liquid compartment extending at least substantially around the screen basket, the annular element forming a plurality of dilution liquid ejection passages between the dilution liquid compartment and one of the central chamber and outer chamber.

2. A screening apparatus according to claim 1, wherein one of the accept outlet member and reject outlet member forms an outlet passage from the outer chamber, and the dilution means comprises at least one dilution liquid supply conduit extending through the outlet passage to the at least one annular element, to supply dilution liquid from outside the housing to the dilution liquid compartment.

3. A screening apparatus according to claim 2, further comprising an outlet pipe releasably connected to the accept outlet member that forms said outlet passage, wherein the dilution liquid supply conduit extends from outside the housing through the wall of the outlet pipe into the outlet passage.

4. A screening apparatus according to claim 1, wherein the dilution means comprises first and second dilution liquid supply conduits connected to the annular element at different places thereon.

5. A screening apparatus according to claim 4, wherein the tubular dilution liquid compartment extends in a closed loop around the central chamber, and the first and second dilution liquid supply conduits are arranged to direct the dilution liquid into the tubular dilution liquid compartment such that the dilution liquid flows in one direction along said closed loop.

6. A screening apparatus according to claim 1, wherein the tubular dilution liquid compartment extends in a closed loop around the central chamber, and the dilution liquid supply conduit is arranged to direct the dilution liquid into the tubular dilution liquid compartment such that the dilution liquid flows in one direction along said closed loop.

7. A screen basket comprising:

a tubular mantle wall provided with screen holes and including at least two separate tubular wall sections, and dilution means for supplying dilution liquid to one of the inside and outside of the tubular mantle wall, the dilution means including at least one annular element axially interconnecting the two separate tubular wall sections of the tubular mantle wall and forming a tubular dilution liquid compartment extending at least substantially around the tubular mantle wall, wherein the annular element forms a plurality of dilution liquid ejection passages between the dilution liquid compartment and one of the inside and outside of the screen basket.

8. A screen basket according to claim 7, wherein the ejection passages have circular cross-sections.

9. A screen basket according to claim 7, wherein the ejection passages take the shape of slots.

10. A screen basket according to claim 7, wherein the tubular dilution liquid compartment has a rectangular cross-section.

11. A screen basket according to claim 7, wherein the dilution means comprises first and second dilution liquid supply inlets on the at least one annular element positioned at different places thereon.

12. A screen basket according to claim 7, wherein the tubular dilution liquid compartment extends in a closed loop around the tubular mantle wall.

* * * * *